US007177556B2

(12) United States Patent
Ishibashi et al.

(10) Patent No.: US 7,177,556 B2
(45) Date of Patent: Feb. 13, 2007

(54) IMAGE FORMATION DEVICE AND RECORDING AGENT CARTRIDGE ATTACHED THERETO

(75) Inventors: Osamu Ishibashi, Nagano-ken (JP); Kazuhiro Ichikawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 62 days.

(21) Appl. No.: 10/797,564

(22) Filed: Mar. 11, 2004

(65) Prior Publication Data

US 2005/0123310 A1 Jun. 9, 2005

(30) Foreign Application Priority Data

Mar. 13, 2003 (JP) ..... 2003-068534
Feb. 25, 2004 (JP) ..... 2004-050199

(51) Int. Cl.
*G03G 15/01* (2006.01)

(52) U.S. Cl. ..... 399/27; 399/28; 399/227; 399/112

(58) Field of Classification Search ..... 399/27–28, 399/227, 12, 111–112
See application file for complete search history.

(56) References Cited

U.S. PATENT DOCUMENTS 6,385,407 B1 * 5/2002 Inose ..... 399/24
6,490,422 B2 * 12/2002 Harumoto ..... 399/27
6,665,501 B2 * 12/2003 Okada et al. ..... 399/27
6,780,553 B2 * 8/2004 Sugimura et al. ..... 430/56
6,807,380 B2 * 10/2004 Iida et al. ..... 399/12
6,834,173 B2 * 12/2004 Yamaguchi et al. ..... 399/119
6,850,722 B2 * 2/2005 Sakemi et al. ..... 399/223
6,871,026 B2 * 3/2005 Shimura et al. ..... 399/12
6,889,024 B2 * 5/2005 Shiraki et al. ..... 399/227
6,954,595 B2 * 10/2005 Tsukida et al. ..... 399/12
2002/0015597 A1 * 2/2002 Okada et al. ..... 399/27
2002/0021909 A1 * 2/2002 Harumoto ..... 399/27
2003/0133719 A1 * 7/2003 Tsuruya et al. ..... 399/12
2004/0101322 A1 * 5/2004 Tsukida et al. ..... 399/27
2005/0105921 A1 * 5/2005 Yoshizuka et al. ..... 399/12

FOREIGN PATENT DOCUMENTS

JP 2001-305920 A 11/2001

* cited by examiner

*Primary Examiner*—Diego Gutierrez
*Assistant Examiner*—Amy R. Cohen

(57) ABSTRACT

Toner cartridges 32C, 32M, 32Y, and 32K have storage elements 33C, 33M, 33Y, and 33K mounted thereon to transmit information carried on electromagnetic wave in a predetermined frequency band. An information receiver transmitter unit 30 is located in a neighborhood of an end of a developer unit 23 with the toner cartridges 32C, 32M, 32Y, and 32K attached thereto to transmit information carried on the electromagnetic wave in the predetermined frequency band to and from a color laser printer 20. While the developer unit 23 is rotated to develop each color component image with a supply of toner from the corresponding one of the toner cartridges 32C, 32M, 32Y, and 32K, the information receiver transmitter unit 30 is controlled to write a cumulative toner consumption and a cumulative number of printed sheets into the corresponding one of the storage elements 33C, 33M, 33Y, and 33K.

22 Claims, 8 Drawing Sheets

FIG.6

| |
|---|
| CARTRIDGE ID |
| DATE OF MANUFACTURE |
| COLOR OF TONER |
| PRINTER ID |
| USE START DATE |
| USE END DATE |
| CUMULATIVE NUMBER OF PRINTED SHEETS |
| CUMULATIVE TONER CONSUMPTION |
| RESIDUAL QUANTITY OF TONER |
| PRINTER CUMULATIVE USE INFORMATION |

IMAGE FORMATION DEVICE AND RECORDING AGENT CARTRIDGE ATTACHED THERETO

BACKGROUND OF THE INVENTION

1. Field of the Invention

The present invention relates to an image formation device and a recording agent cartridge attached to the image formation device. More specifically the invention pertains to an image formation device that uses recording agents of multiple colors to form a color image on a medium like paper, as well as to an image formation device that uses a recording agent to form an image on a medium like paper. The invention also pertains to a recording agent cartridge that is attached to the image formation device and is filled with a recording agent of one of multiple colors used to form a color image, as well as to a recording agent cartridge that is attached to the image formation device and is filled with a recording agent used to form an image.

2. Description of the Prior Art

A printer with a toner cartridge having a storage element attached thereto has been proposed as an image formation device (see, for example, Japanese Patent Laid-Open Gazette No. 2001-305920). This prior art printer establishes electrical connection with a storage element of a toner cartridge attached thereto and counts up the number of printed sheets, which is stored as a piece of information in the storage element, on completion of each image printing. When the toner cartridge is detached from the printer, information, such as the count of printed sheets, stored in the storage element of the toner cartridge is sent to a computer at a service center connecting with the printer via a communication line. Such information is used for the accounting procedure by the computer at the service center.

In this prior art printer, the toner cartridge attached to the printer is not moved in the printing process. This keeps the electrical connection between the printer and the storage element of the toner cartridge. In the structure of moving the toner cartridge in the printing process, however, there is difficulty in keeping the electrical connection between the printer and the storage element of the toner cartridge. For example, in a color laser printer that prints a color image by a single photoreceptor system, respective color toner images are formed on a photoreceptor with movement of four color toner cartridges, cyan, magenta, yellow, and black. This system makes it difficult to keep the electrical connection between the color printer and the storage element of each toner cartridge. Especially in the case of rotation of such four color toner cartridges received in a rotary body, it is impossible to keep the electrical connection between the color printer and the storage element of each toner cartridge. One possible countermeasure causes the color printer to establish intermittent electrical connection with the storage element of each toner cartridge with rotation of the rotary body. This method may, however, lead to a trouble like a loose connection due to the wear of a contact. The similar problem arises in a monochromatic printer with toner cartridges of identical color toner (for example, black toner), which are attached to the printer in place of the four color toner cartridges and are used independently for image formation by multiple users.

SUMMARY OF THE INVENTION

The image formation device of the invention, which forms an image with movement of a recording agent cartridge, thus aims to adequately store image formation-relating information into a storage element of the recording agent cartridge. The recording agent cartridge of the invention aims to be suitable for attachment to an image formation device that forms an image with movement of the recording agent cartridge.

In order to attain at least part of the above and the other related objects, the invention is directed to an image formation device and a recording agent cartridge attached to the image formation device constructed as discussed below.

A first image formation device of the invention uses recording agents of multiple colors to form a color image on a medium like paper, and includes: an image formation module that holds multiple recording agent cartridges respectively filled with the recording agents of the multiple colors in an attachable and detachable manner and moves the multiple recording agent cartridges to form corresponding color component images and eventually form a color image with supplies of the recording agents from the multiple recording agent cartridges; an information transmission module that is located in a moving range of the multiple recording agent cartridges in the course of image formation by the image formation module and transmits information in a contactless, storable manner to each of storage elements respectively mounted on the multiple recording agent cartridges; and a control module that controls the information transmission module to store image formation-relating information, which regards formation of the color image by the image formation module, into each of the storage elements mounted on the multiple recording agent cartridges.

In the first image formation device of the invention, the image formation module moves the multiple recording agent cartridges and forms a color image with supplies of recording agents from the multiple recording agent cartridges. The first image formation device stores the image formation-relating information regarding formation of the color image in a contactless manner into each of the storage elements mounted on the multiple recording agent cartridges. This arrangement enables the image formation-relating information to be stored into each of the storage elements of the multiple recording agent cartridges without requiring any electrical hardware connection between the image formation device and the storage element. This structure is free from any potential trouble of the electrical hardware connection, for example, a potential loose connection due to the wear of a contact.

In one application of the first image formation device of the invention, the control module may control the information transmission module to store the image formation-relating information into each of the storage elements mounted on the multiple recording agent cartridges at a specific timing after completion of formation of the color image by the image formation module. Further, the control module may control the information transmission module to store previous image formation-relating information, which regards formation of a previous color image, in the course of formation of the corresponding color component images by the image formation module. Moreover, the control module may control the information transmission module to store the image formation-relating information into a storage element mounted on one of the multiple recording agent cartridges filled with a recording agent of each of the multiple colors at an end timing of formation of the corresponding color component image by the image formation module.

In another application of the first image formation device of the invention, the image formation-relating information may include at least either of a number of formed images with regard to each of the multiple colors and a consumption of the recording agent with regard to each of the multiple colors. In addition, the multiple recording agent cartridges may be filled with recording agents of four colors, that is, cyan, magenta, yellow, and black.

In still another application of the first image formation device of the invention, the image formation module may separately hold the multiple recording agent cartridges on a rotatable, quasi-cylindrical rotary holder unit and rotate the rotary holder unit to form the respective color component images. In this case, each of the multiple recording agent cartridges may be designed to have a substantially fan-shaped cross section and form a substantially circular cross section as a whole in the case of attachment of the multiple recording agent cartridges to the rotary holder unit. Additionally, the information transmission module may be located in a neighborhood of an end of the rotary holder unit. Further, the information transmission module may be located to successively face the storage elements mounted on the multiple recording agent cartridges with rotation of the rotary holder unit.

A second image formation device of the invention uses a recording agent to form an image on a medium like paper, and includes: an image formation module that holds multiple recording agent cartridges respectively filled with the recording agent in an attachable and detachable manner and moves the multiple recording agent cartridges to form an image on the medium with a supply of the recording agent from at least one recording agent cartridge among the multiple recording agent cartridges; an information transmission module that is located in a moving range of the multiple recording agent cartridges and transmits information in a contactless, storable manner to each of storage elements respectively mounted on the multiple recording agent cartridges; and a control module that controls the information transmission module to store image formation-relating information, which regards formation of the image by the image formation module, into each of the storage elements mounted on the multiple recording agent cartridges.

In the second image formation device of the invention, the image formation module moves the multiple recording agent cartridges and forms an image with supplies of recording agents from the multiple recording agent cartridges. The first image formation device stores the image formation-relating information regarding formation of the color image in a contactless manner into each of the storage elements mounted on the multiple recording agent cartridges. This arrangement enables the image formation-relating information to be stored into each of the storage elements of the multiple recording agent cartridges without requiring any electrical hardware connection between the image formation device and the storage element. This structure is free from any potential trouble of the electrical hardware connection, for example, a potential loose connection due to the wear of a contact.

The second image formation device of the invention may further include a cartridge specification module that specifies one recording agent cartridge among the multiple recording agent cartridges. In this image formation device of the invention, the image formation module may form the image with a supply of the recording agent from the one recording agent cartridge specified by the cartridge specification module.

In one application of the second image formation device of the invention, the control module may control the information transmission module to store the image formation-relating information into each of the storage elements mounted on the multiple recording agent cartridges at a specific timing after completion of formation of the image by the image formation module. In this case, the control module may control the information transmission module to store previous image formation-relating information, which regards formation of a previous image, in the course of formation of the image by the image formation module. Further, the control module may control the information transmission module to store the image formation-relating information into a storage element mounted on a recording agent cartridge used for image formation at an end timing of the image formation by the image formation module. In another case, the control module may control the information transmission module to store the image formation-relating information into a storage element mounted on a specified recording agent cartridge, in response to a detachment instruction of the specified recording agent cartridge.

In another application of the second image formation device of the invention, the image formation-relating information may include at least either of a number of formed images and a consumption of the recording agent.

In still another application of the second image formation device of the invention, the image formation module may separately hold the multiple recording agent cartridges on a rotatable, quasi-cylindrical rotary holder unit and rotates the rotary holder unit to form the image. In this case, each of the multiple recording agent cartridges may be designed to have a substantially fan-shaped cross section and form a substantially circular cross section as a whole in the case of attachment of the multiple recording agent cartridges to the rotary holder unit. Moreover, the information transmission module may be located in a neighborhood of an end of the rotary holder unit. Further, the information transmission module may be located to successively face the storage elements mounted on the multiple recording agent cartridges with rotation of the rotary holder unit.

In the first and second image formation device of the invention, the storage element may include: a memory unit that stores information; a receiver unit that receives electromagnetic wave in a predetermined frequency band; an information analyzer unit that analyzes information carried on the electromagnetic wave in the predetermined frequency band received by the receiver unit; and an information control unit that, when the analyzed information includes storage instruction information for storage of the image formation-relating information, controls the memory unit to store the image formation-relating information, which is sent on the electromagnetic wave in the predetermined frequency band and is analyzed by the information analyzer unit, and the information transmission module transmits the information carried on the electromagnetic wave in the predetermined frequency band. In this case, the storage element may further include a power supply unit that utilizes energy of the electromagnetic wave in the predetermined frequency band received by the receiver unit to generate electric power required for the analysis of information by the information analyzer unit and for the storage of information by the information control unit.

A first recording agent cartridge of the invention is attached to an image formation device functioning to form a color image and is filled with a recording agent of one of multiple colors used for formation of the color image, the recording agent cartridge, and includes: a storage element that utilizes energy of received electromagnetic wave in a predetermined frequency band to store information sent on the electromagnetic wave.

The first recording agent cartridge of the invention receives the information sent on the electromagnetic wave in the predetermined frequency band from the image formation device and stores the received information into the storage element. This arrangement does not require any electrical hardware connection between the storage element of the recording agent cartridge and the image formation device. The recording agent cartridge may be filled with toner as the recording agent.

The first recording agent cartridge of the invention may be designed to have a substantially fan-shaped cross section and form a substantially circular cross section as a whole in the case of attachment of multiple recording agent cartridges respectively filled with recording agents of the multiple colors to the image formation device.

A second recording agent cartridge of the invention is attached to an image formation device functioning to form an image and is filled with a recording agent used for formation of the image. The second recording agent cartridge may include: a storage element that utilizes energy of received electromagnetic wave in a predetermined frequency band to store information sent on the electromagnetic wave.

The second recording agent cartridge of the invention receives the information sent on the electromagnetic wave in the predetermined frequency band from the image formation device and stores the received information into the storage element. This arrangement does not require any electrical hardware connection between the storage element of the recording agent cartridge and the image formation device. The recording agent cartridge may be filled with toner as the recording agent.

In one application, the second recording agent cartridge of the invention may be designed to have a substantially fan-shaped cross section and form a substantially circular cross section as a whole in the case of attachment of a preset number of the recording agent cartridges to the image formation device.

In the first and second recording agent cartridge of the invention, the storage element may include: a memory unit that stores information; a receiver unit that receives electromagnetic wave in a predetermined frequency band; an information analyzer unit that analyzes information carried on the electromagnetic wave in the predetermined frequency band received by the receiver unit; and an information control unit that, when the analyzed information includes storage instruction information for storage of the image formation-relating information, controls the memory unit to store the image formation-relating information, which is sent on the electromagnetic wave in the predetermined frequency band and is analyzed by the information analyzer unit, and a power supply unit that utilizes energy of the electromagnetic wave in the predetermined frequency band received by the receiver unit to generate electric power required for the analysis of information by the information analyzer unit and for the storage of information by the information control unit.

BRIEF DESCRIPTION OF THE DRAWINGS

FIG. 6 shows one example of information stored in the storage element 30;

DESCRIPTION OF THE PREFERRED EMBODIMENTS

Figure 1:
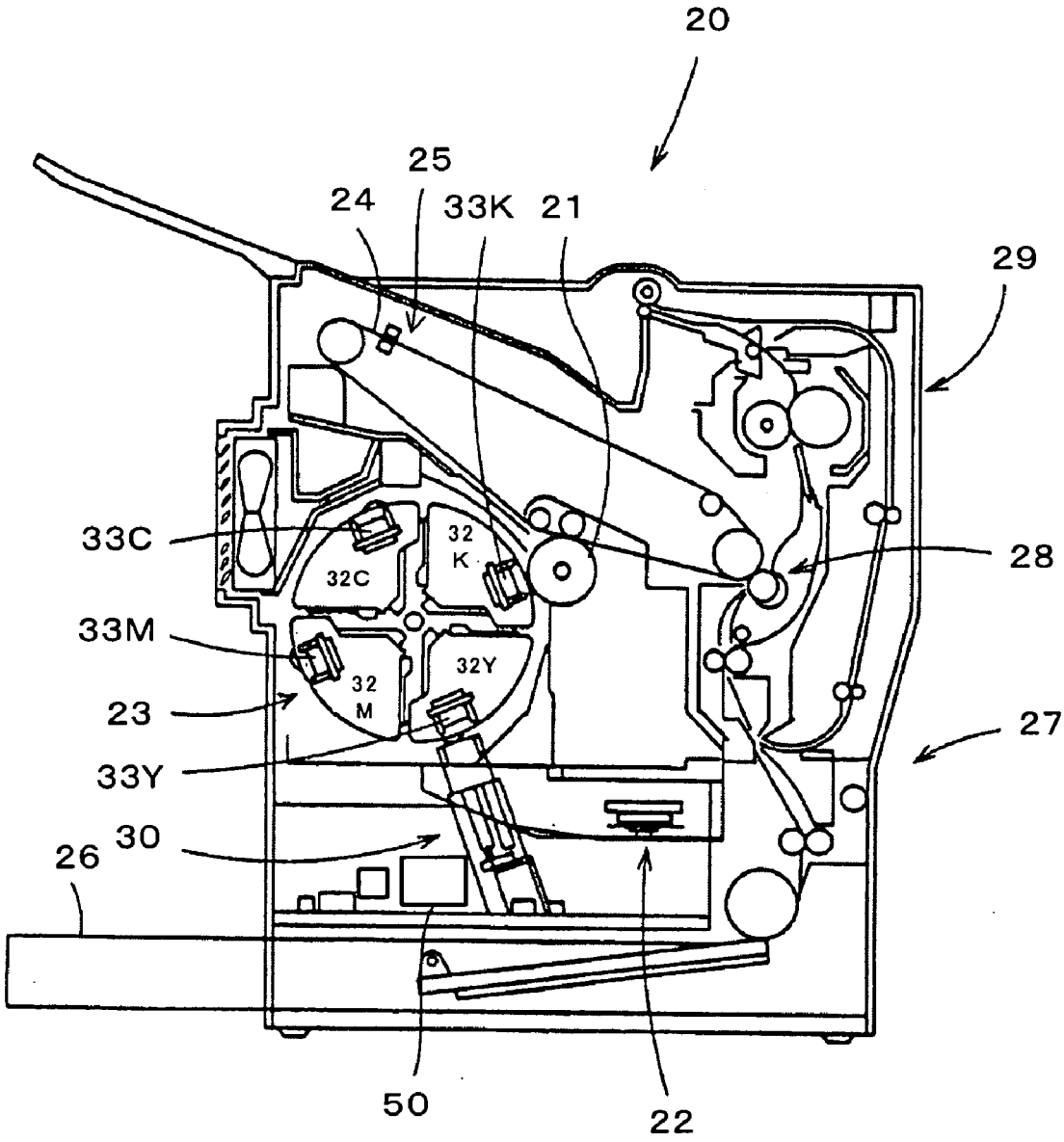
FIG. 1 schematically illustrates the structure of a color laser printer 20.
Figure 2:
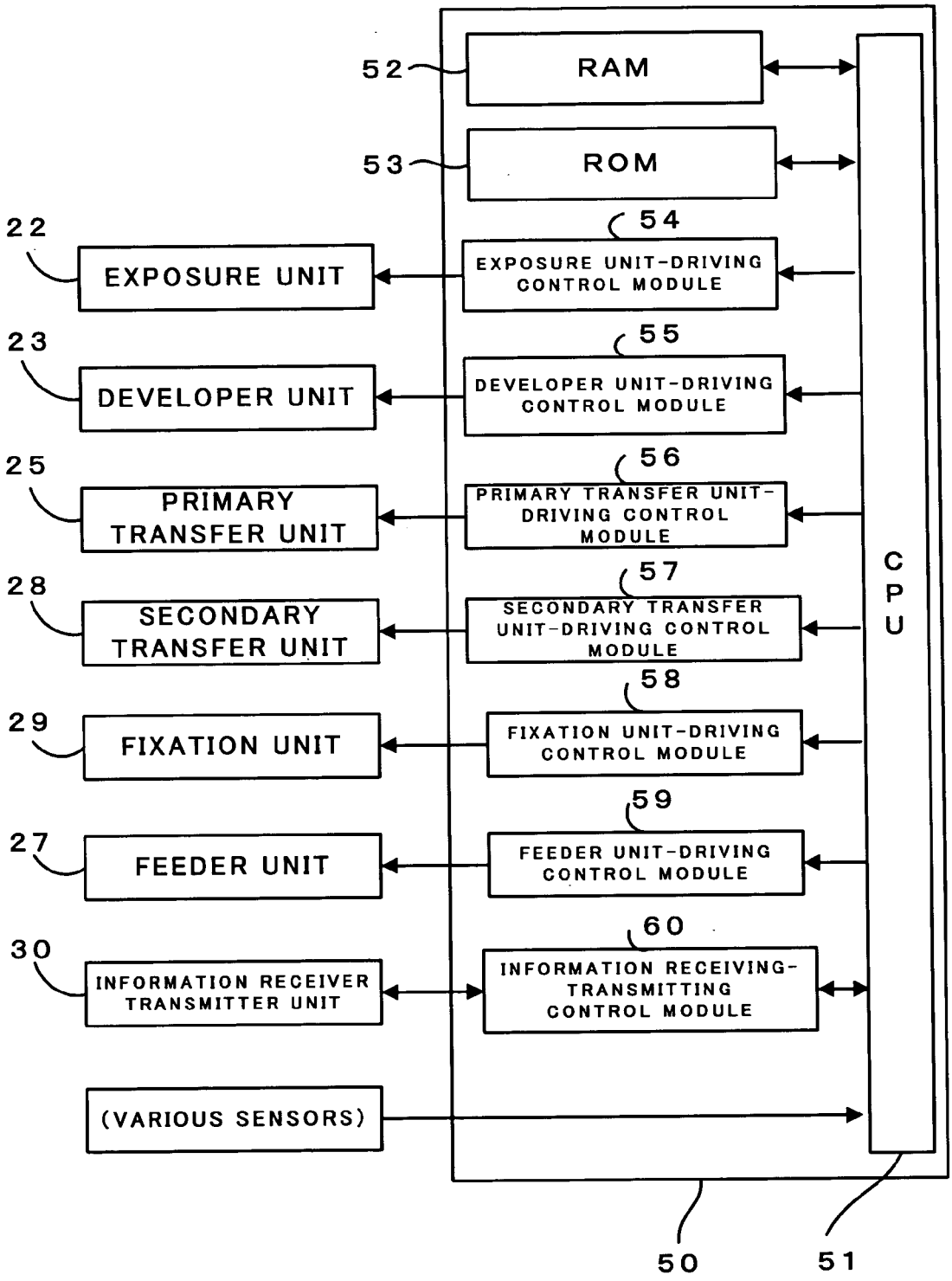
FIG. 2 is a block diagram showing input and output of control signals to and from a controller 50.

Preferred embodiments of the invention are discussed below. FIG. 1 schematically illustrates the structure of a color laser printer 20 in one embodiment of the invention. FIG. 2 is a block diagram showing input and output of control signals to and from a controller 50 in the color laser printer 20 of the embodiment.

The color laser printer 20 is constructed as a full-color electrophotographic image formation device that adopts a single photoreceptor system and an intermediate transfer system. As shown in FIG. 1, the color laser printer 20 includes an exposure unit 22 that irradiates a charged photoreceptor 21 with laser and thereby forms color-separated images of four color components, cyan (C), magenta (M), yellow (Y), and black (K), as electrostatic latent images on the photoreceptor 21, and a developer unit 23 that develops the electrostatic latent images formed on the photoreceptor 21 as toner images of the respective colors with corresponding color toners respectively fed from toner cartridges 32C, 32M, 32Y, and 32K (hereafter may be generically referred to as the toner cartridge '32') attached to the developer unit 23. The color laser printer 20 further includes a primary transfer unit 25 that transfers the toner images of the respective colors developed on the photoreceptor 21 onto a transfer belt 24 in an overlapping manner to form a composite color toner image, a feeder unit 27 that conveys printing paper from a paper cassette 26, a secondary transfer unit 28 that further transfers the composite color toner image formed on the transfer belt 24 onto the conveyed printing paper, and a fixation unit 29 that fuses and fixes the transferred composite color toner image on the printing paper and delivers the printing paper with the fixed composite color toner image. The color laser printer 20 also includes an information receiver transmitter unit 30 that transmits information in a contactless manner to and from storage elements 33C, 33M, 33Y, and 33K (hereafter may be generically referred to as the storage element '33') mounted on the respective toner cartridges 32C, 32M, 32Y, and 32K with rotation of the developer unit 23, and a controller 50 that controls all the operations of the color laser printer 20.

As illustrated, the controller 50 is constructed as a microprocessor including a CPU 51, a RAM 52, and a ROM 53, and receives measurement results of various sensors (for example, a temperature sensor) and other input signals (for example, a print instruction signal entered by an operator) via signal lines. In response to these input signals, the controller 50 controls the operations of the respective constituents of the color laser printer 20, that is, the exposure unit 22, the developer unit 23, the primary transfer unit 25, the secondary transfer unit 28, the fixation unit 29, and the feeder unit 27, via an exposure unit-driving control module 54, a developer unit-driving control module 55, a primary transfer unit-driving control module 56, a secondary transfer unit-driving control module 57, a fixation unit-driving control module 58, and a feeder unit-driving control module 59. The controller 50 also controls the information receiver transmitter unit 30 to transmit information to and from the storage elements 33C, 33M, 33Y, and 33K of the respective toner cartridges 32C, 32M, 32Y, and 32K via an information receiving-transmitting control module 60.

As shown in FIG. 1, the developer unit 23 is designed to have a quasi-cylindrical shape as a whole to receive the four toner cartridges 32C, 32M, 32Y, and 32K having fan-shaped end faces at a center angle of approximately 90 degrees. The developer unit 23 is rotated clockwise in FIG. 1 about its center axis by 90 degrees four times to sequentially locate the four toner cartridges 32C, 32M, 32Y, and 32K at a position facing the photoreceptor 21 and develop the four toner images of the corresponding colors on the photoreceptor 21. The four toner images of the respective colors developed on the photoreceptor 21 are transferred to the transfer belt 24 of the primary transfer unit 25 in an overlapping manner to form a composite color toner image. The composite color toner image is then transferred by the secondary transfer unit 28 onto the printing paper fed by the feeder unit 27 and is fixed by the fixation unit 29. The printing paper with the fixed composite color toner image is eventually delivered from the color laser printer 20.

Figure 3:
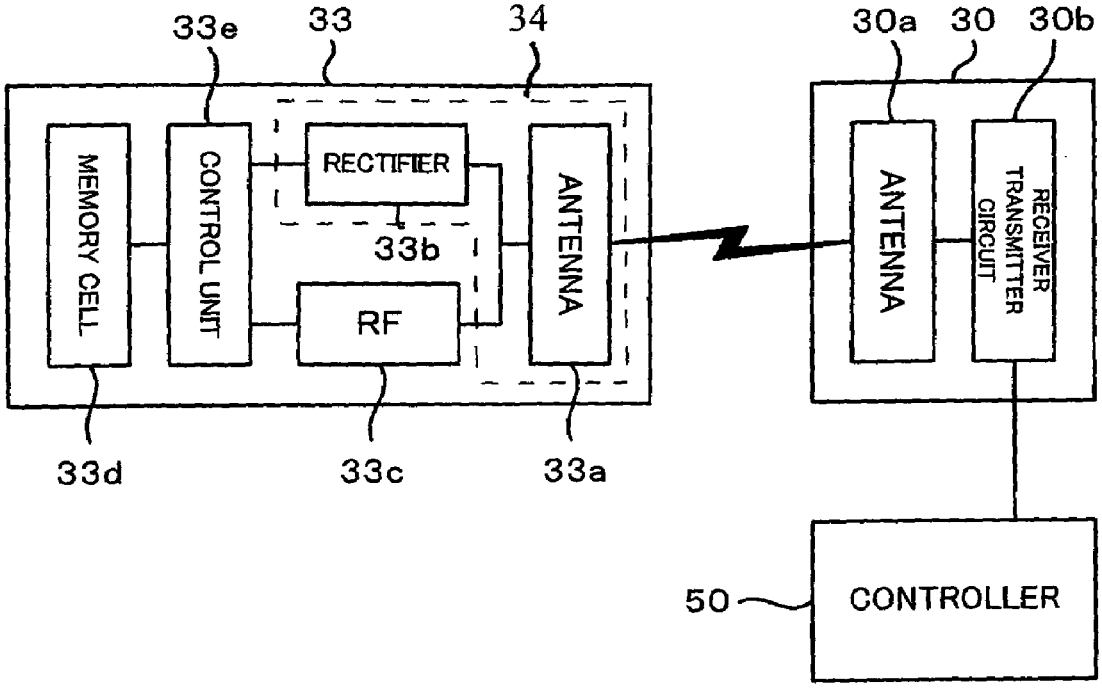
FIG. 3 shows connection between an information receiver transmitter unit 30 and a storage element 33.

As shown in FIG. 1, the information receiver transmitter unit 30 is located at an angle of approximately 90 degrees with the photo receptor 21 about the center of rotation of the developer unit 23, that is, at the position facing the storage element 33Y of the toner cartridge 32Y while the toner cartridge 32K faces the photoreceptor 21 for development of a toner image of the corresponding color. The connection between the information receiver transmitter unit 30 and the storage element 33 is shown in FIG. 3. As illustrated, the information receiver transmitter unit 30 includes an antenna 30*a* that receives and transmits electromagnetic wave in a predetermined frequency band (for example, electromagnetic wave in a 2.45 GHz band, hereafter referred to as the information receiving-transmitting electromagnetic wave), and a receiver transmitter circuit 30*b* that causes information (data) output from the controller 50 to be carried on the information receiving-transmitting electromagnetic wave and to be transmitted via the antenna 30*a*, while analyzing the information (data) carried on the information receiving-transmitting electromagnetic wave received via the antenna 30*a* to input the analyzed information into the controller 50.

Figure 4:
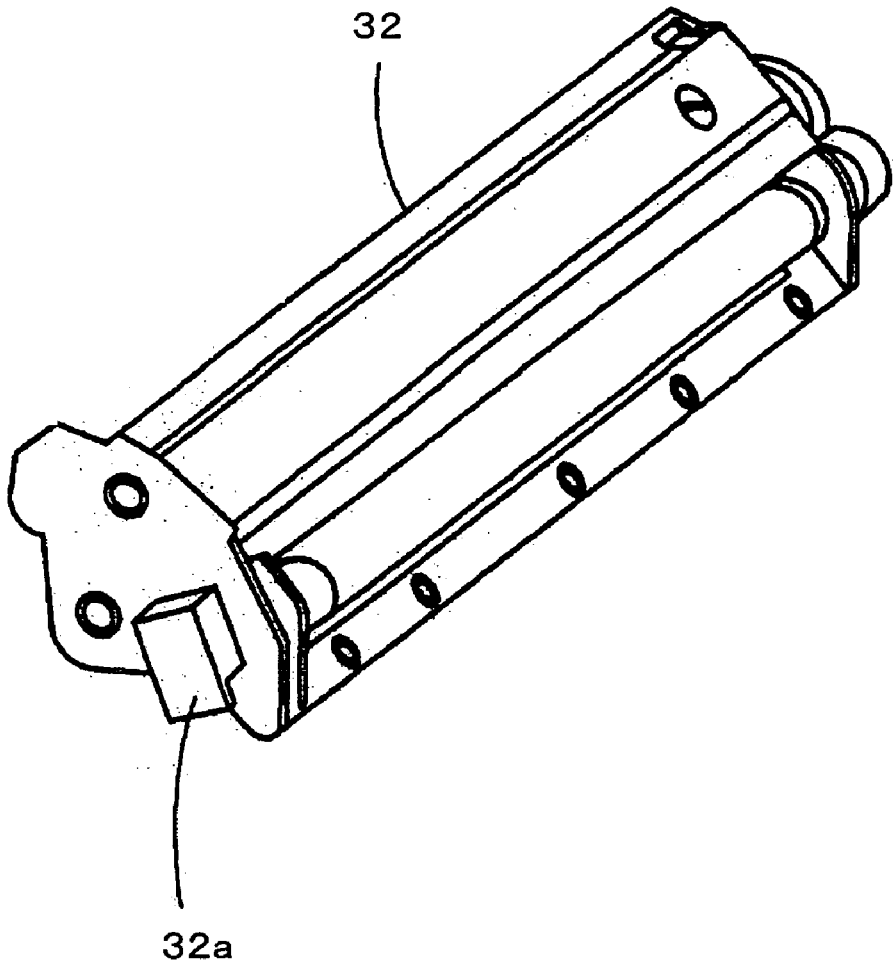
FIG. 4 illustrates the appearance of a toner cartridge 32.

The storage element 33 is received in a holder unit 32*a* of the toner cartridge 32 as shown in FIG. 4. As shown in FIG. 3, the storage element 33 includes an antenna 33*a* that receives and transmits signals on electromagnetic wave in a predetermined frequency band (for example, electromagnetic wave in the 2.45 GHz band, hereafter referred to as the information receiving-transmitting electromagnetic wave), a rectifier 33*b* that rectifies the received electromagnetic wave and supplies the energy of the rectified electromagnetic wave as electric power, a signal analyzer RF (radio frequency) 33*c* that analyzes each received signal, and a memory cell 33*d* that stores information. The storage element 33 also has a control unit 33*e* that stores information (data), which is extracted from the signal received via the antenna 33*a* and analyzed by the signal analyzer RF 33*c*, into the memory cell 33*d*, while reading the information (data) from the memory cell 33*d* and transmitting the read-out information on the receiving-transmitting electromagnetic wave via the signal analyzer RF 33*c* and the antenna 33*a*.

Figure 5:
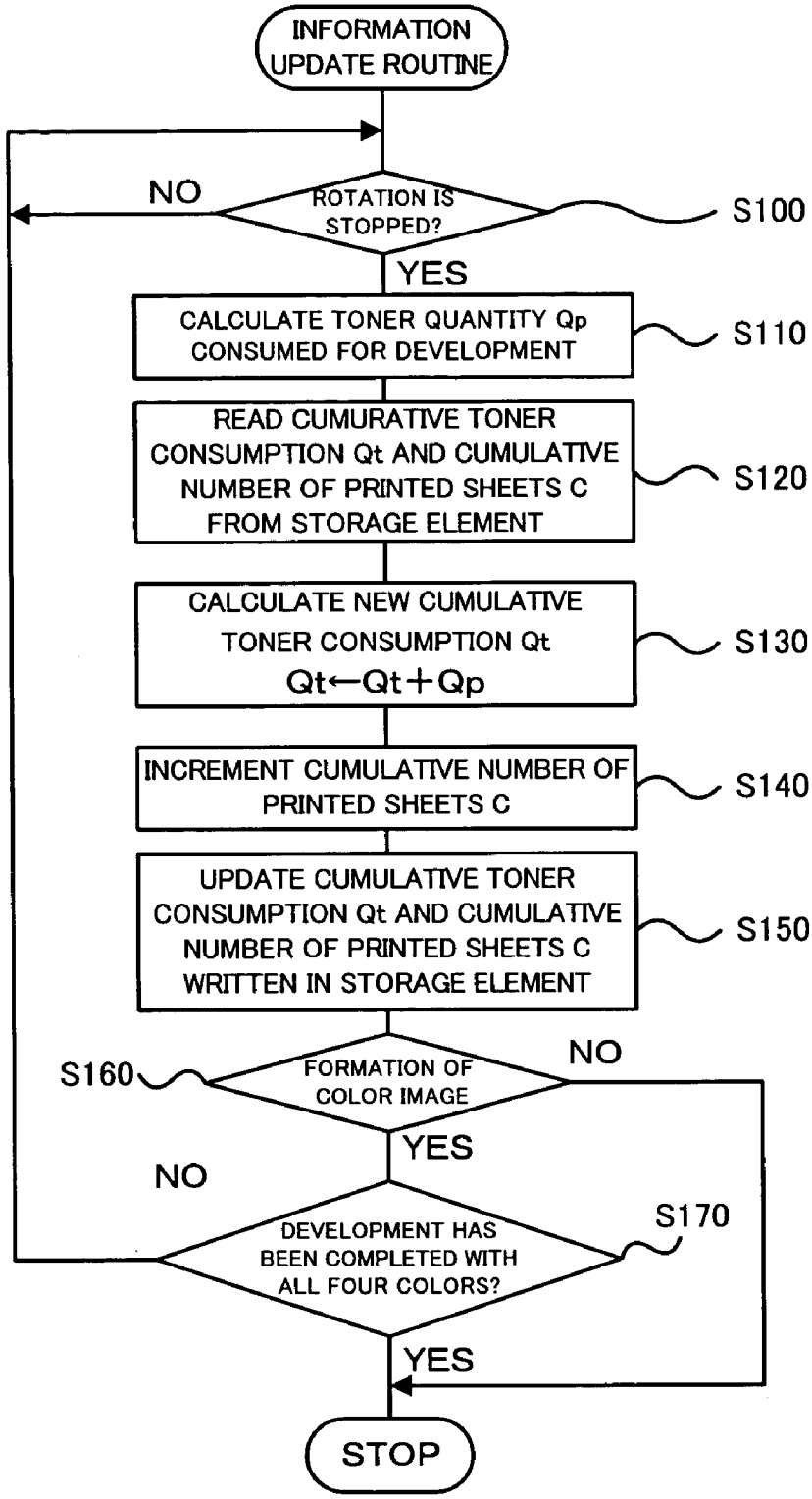
FIG. 5 is a flowchart showing an information update routine.

The following describes the operations of the color laser printer 20 of the embodiment constructed as discussed above, especially a series of operations to store information into the storage elements 33C, 33M, 33Y, and 33K of the toner cartridges 32C, 32M, 32Y, and 32K in the process of image formation. FIG. 5 is a flowchart showing an information update routine executed by the controller 50 in the color laser printer 20. This information update routine is executed, in response to an image formation instruction.

When the information update routine starts, the CPU 51 of the controller 50 first waits for stop of a rotation of the developer unit 23 (step S100). In the structure of the embodiment, the rotational position where the toner cartridge 32K faces the photoreceptor 21 as shown in FIG. 1 is the default position. The developer unit 23 starts development with black toner supplied from the toner cartridge 32K at this default position, and is successively rotated clockwise by 90 degrees to sequentially carry out development with cyan toner supplied from the toner cartridge 32C, development with magenta toner supplied from the toner cartridge 32M, and development with yellow toner supplied from the toner cartridge 32Y. Immediately after the start of the information update routine, the developer unit 23 carries out development with black toner supplied from the toner cartridge 32K and has not yet been rotated for subsequent development. The stop of a rotation is accordingly not detected at this moment. On completion of development with the toner cartridge 32K, the developer unit 23 is rotated clockwise by 90 degrees and stops its rotation to start development with cyan toner supplied from the toner cartridge 32C.

When development with one color toner is completed and a rotation of the developer unit 23 is stopped, the routine calculates a toner quantity Qp of the toner cartridge 32 consumed for the development, that is, the toner cartridge 32 having the storage element 33 located at the position facing the information receiver transmitter unit 30 (the toner cartridge 32K on completion of development with black toner) (step S110). The calculation of the toner quantity Qp counts up irradiation points of layer beam on the photoreceptor 21 and converts the count of irradiation points into the quantity of toner.

The routine then controls the information receiver transmitter unit 30 to read a cumulative toner consumption Qt and a cumulative number of printed sheets C from the memory cell 33*d* of the storage element 33 mounted on the toner cartridge 32 located at the position facing the information receiver transmitter unit 30 (step S120). The information receiver transmitter unit 30 is controlled to make a control signal for transmission of the cumulative toner consumption Qt and the cumulative number of printed sheets C carried on the electromagnetic wave in the predetermined frequency band and to send the electromagnetic wave with the control signal via the antenna 30*a*. In the information receiver transmitter unit 30, the antenna 30*a* receives the cumulative toner consumption Qt and the cumulative number of printed sheets C, as the information carried on the electromagnetic wave in the predetermined frequency band sent from the antenna 33*a* of the storage element 33. The receiver transmitter circuit 30*b* then analyzes the received information. FIG. 6 shows one example of the information stored in the memory cell 33*d* of the storage element 33. In the illustrated example, the information stored in the memory cell 33*d* includes an ID allocated to each toner cartridge 32 (cartridge ID), the date of manufacture of the toner cartridge 32, the color of toner kept in the toner cartridge 32, an ID allocated to the color laser printer 20 having the toner cartridge 32 attached thereto (printer ID), the use start date when the toner cartridge 32 was attached to the color laser printer 20 and the use of the toner cartridge 32 started, the use end date when the toner cartridge 32 was detached from the color laser printer 20, the cumulative number of printed sheets with images printed thereon with the toner cartridge 32 by the color laser printer 20, the cumulative toner consumption consumed for printing the images with the toner cartridge 32 by the color laser printer 20, the residual quantity of toner remaining in the toner cartridge 32, and printer cumulative use information regarding cumulative use of the color laser printer 20 including the total number of printed sheets with images printed thereon. Among these pieces of information, the cartridge ID, the date of manufacture, and the color of toner are written into the memory cell 33*d* as factory settings at the time of manufacture of the toner cartridge 32. The printer ID and the use start date are written by the color laser printer 20 when the toner cartridge 32 is attached to the color laser printer 20. The cumulative number of printed sheets, the cumulative toner consumption, and the residual quantity of toner are updated by the color laser printer 20 in a subsequent series of processing of the information update routine discussed below. The use end date and the printer cumulative use information are written by the color laser printer 20 when the toner cartridge 32 is detached from the color laser printer 20.

After reading the cumulative toner consumption Qt and the cumulative number of printed sheet C, the routine adds the calculated toner quantity Qp to the cumulative toner consumption Qt to calculate the new cumulative toner consumption Qt (step S130) and increments the cumulative number of printed sheets C by one (step S140). The routine then updates the cumulative toner consumption Qt and the cumulative number of printed sheets C written in the memory cell 33*d* of the storage element 33 (step S150). The procedure of updating the cumulative toner consumption Qt and the cumulative number of printed sheets C controls the information receiver transmitter unit 30 to make a control signal for updating the cumulative toner consumption Qt and the cumulative number of printed sheets C carried on the electromagnetic wave in the predetermined frequency band and to send the electromagnetic wave with the control signal via the antenna 30*a*. The information receiver transmitter unit 30 is also controlled to send the new cumulative toner consumption Qt and the incremented cumulative number of printed sheets C carried on the electromagnetic wave via the antenna 30*a*. In the storage element 33, the transmitted cumulative toner consumption Qt and cumulative number of printed sheets C are received by the antenna 33*a* and are analyzed by the signal analyzer RF 33*c*. The control unit 33*e* receives the control signal via the antenna 33*a* and stores the analyzed cumulative toner consumption Qt and cumulative number of printed sheets C at corresponding storage locations in the memory cell 33*d*.

The routine subsequently determines whether the current image formation is formation of a color image or formation of a monochromatic image (step S160). In the case of formation of a monochromatic image, the information update routine is terminated here. The image formation process of a monochromatic image terminates after development with only black toner. The image formation process of a color image, on the other hand, sequentially carries out development with black, cyan, magenta, and yellow toners. Namely the formation of a monochromatic image requires the processing of steps S110 through S150 only once to update the information written in the storage element 33K of the toner cartridge 32K. In the case of formation of a color image, on the other hand, the routine determines whether development has been completed with all the four color toners (step S170). When development with all the four color toners has not yet been completed, the routine goes back to step S100. When development with all the four color toners has already been completed, the information update routine is terminated. In the case of formation of a color image, the information update routine sequentially updates the cumulative toner consumption Qt and the cumulative number of printed sheets C written in the storage elements 33K, 33C, 33M, and 33Y of the respective color toner cartridges 32K, 32C, 32M, and 32Y, while the developer unit 23 is rotated by 90 degrees four times. The updated cumulative toner consumption Qt and the updated cumulative number of printed sheets C may be applied to accounting for image formation by the color laser printer 20, after collection of each toner cartridge.

As described above, the color laser printer 20 of the embodiment transmits information in a contactless manner to and from the storage elements 33C, 33M, 33Y, and 33K of the toner cartridges 32C, 32M, 32Y, and 32K attached to the developer unit 23. The image formation-relating information (for example, the cumulative toner consumption Qt and the cumulative number of printed sheets C) is thus written at each timing of image formation into the storage elements 33C, 33M, 33Y, and 33K of the respective toner cartridges 32C, 32M, 32Y, and 32K. Update of the information written in the storage elements 33C, 33M, 33Y, and 33K is synchronous with the rotation of the developer unit 23. No additional actuation of the developer unit 23 is accordingly required just for update of the information. The image formation process of a color image updates the cumulative toner consumption Qt and the cumulative number of printed sheets C written in the storage elements 33C, 33M, 33Y, and 33K of all the four color toner cartridges 32C, 32M, 32Y, and 32K. The image formation process of a monochromatic image, on the other hand, updates the cumulative toner consumption Qt and the cumulative number of printed sheets C written in the storage elements 33K of only the black toner cartridge 32K. The accounting procedure of each toner cartridge facilitates accounting for formation of each color image and accounting for formation of each monochromatic image. Each of the toner cartridges 32C, 32M, 32Y, and 32K is designed to have fan-shaped end faces of approximately 90 degrees, while the developer unit 23 has a quasi-cylindrical shape as a whole. Development with the respective color toners is carried out with the four rotations of the developer unit 23 by 90 degrees each. This arrangement desirably reduces the required size of the printer, compared with a conventional tandem-type printer having four toner cartridges aligned along a transfer belt.

The toner cartridges 32C, 32M, 32Y, and 32K in the color laser printer 20 of the embodiment correspond to the multiple recording agent cartridges of the invention. The combination of the photoreceptor 21, the developer unit 23, the primary transfer unit 25, the secondary transfer unit 28, and the fixation unit 29 is equivalent to the image formation module of the invention. The information receiver transmitter unit 30 and the controller 50 respectively correspond to the information transmission module and the control module of the invention. The storage elements 33C, 33M, 33Y, and 33K mounted on the toner cartridges 32C, 32M, 32Y, and 32K of the embodiment correspond to the storage elements of the invention. The memory cell 33*d*, the antenna 33*a*, the signal analyzer RF 33*c*, the control unit 33*e*, and the rectifier 33*b* are respectively equivalent to the memory unit, the receiver unit, the information analyzer unit, the information control unit, and the power supply unit 34 (e.g., antenna 33*a* and rectifier 33*b*) of the invention.

The toner cartridges 32C, 32M, 32Y, and 32K in the color laser printer 20 of the embodiment correspond to the multiple recording agent cartridges of the invention. The combination of the photoreceptor 21, the developer unit 23, the primary transfer unit 25, the secondary transfer unit 28, and the fixation unit 29 is equivalent to the image formation module of the invention. The information receiver transmitter unit 30 and the controller 50 respectively correspond to the information transmission module and the control module of the invention. The storage elements 33C, 33M, 33Y, and 33K mounted on the toner cartridges 32C, 32M, 32Y, and 32K of the embodiment correspond to the storage elements of the invention. The memory cell 33*d*, the antenna 33*a*, the signal analyzer RF 33*c*, the control unit 33*e*, and the rectifier 33*b* are respectively equivalent to the memory unit, the receiver unit, the information analyzer unit, the information control unit, and the power supply unit of the invention.

The color laser printer 20 of the embodiment updates both the cumulative toner consumption Qt and the cumulative number of printed sheets C written in the storage elements 33C, 33M, 33Y, and 33K of the toner cartridges 32C, 32M, 32Y, and 32K at each timing of image formation. Possible modification may update only the cumulative toner consumption Qt or the cumulative number of printed sheets C.

The color laser printer 20 of the embodiment updates the cumulative toner consumption Qt and the cumulative number of printed sheets C written in the storage element 33 of each toner cartridge 32 on completion of development with the corresponding color toner. One modified procedure may rotate the developer unit 23 again by 90 degrees four times to update the cumulative toner consumption Qt and the cumulative number of printed sheets C written in the storage elements 33C, 33M, 33Y, and 33K of all the four color toner cartridges 32C, 32M, 32Y, and 32K on completion of development with all the four color toners. This modified procedure updates the cumulative toner consumption Qt and the cumulative number of printed sheets C as the image formation-relating information after the image formation is completely accomplished. A further modification may update the cumulative toner consumption Qt and the cumulative number of printed sheets C with regard to a previous cycle of image formation in the course of a subsequent cycle of image formation. This procedure does not require the additional rotation of the developer unit 23 to update the cumulative toner consumption Qt and the cumulative number of printed sheets C.

In the color laser printer 20 of the embodiment, the four toner cartridges 32C, 32M, 32Y, and 32K filled with four color toners, that is, cyan, magenta, yellow, and black are attached to the developer unit 23. Six toner cartridges additionally including those filled with light cyan and light magenta or seven toner cartridges additionally including those filled with dark yellow as well as light cyan and light magenta may be attached to the developer unit 23.

The embodiment discussed above regards the color laser printer 20 with the toner cartridges 32C, 32M, 32Y, and 32K filled with multiple color toners as recording agents. The technique of the invention is also applicable to a color photocopier with similar toner cartridges 32C, 32M, 32Y, and 32K and to a printer that forms images with multiple color inks as the recording agents.

Figure 7:
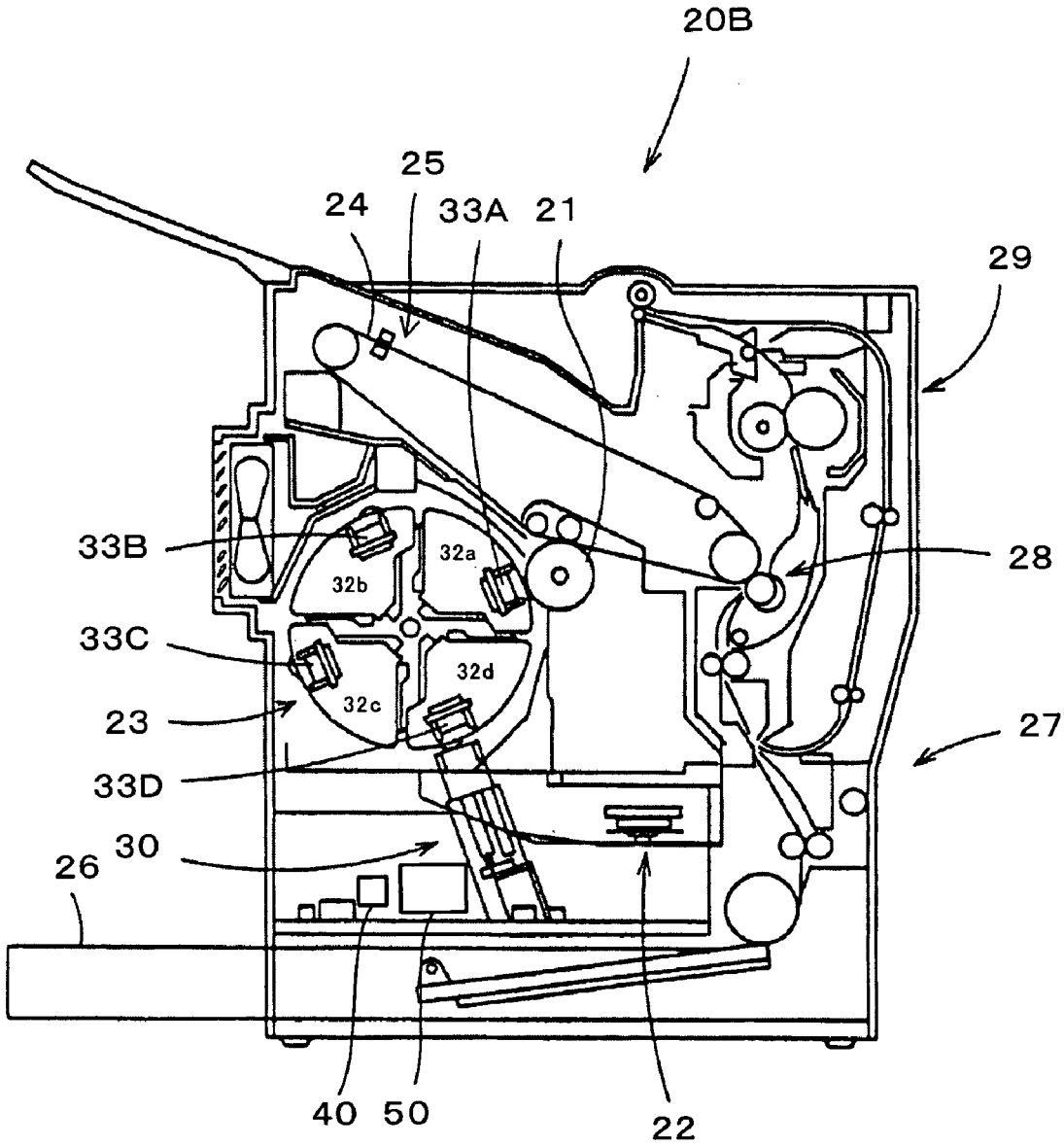
FIG. 7 schematically illustrates the structure of a laser printer 20B in a second embodiment.

The following describes a laser printer 20B in a second embodiment of the invention. FIG. 7 schematically illustrates the structure of the laser printer 20B of the second embodiment. The laser printer 20B of the second embodiment has a similar hardware configuration to that of the color laser printer 20 of the embodiment, except that four toner cartridges 32*a* through 32*d* are attached to the developer unit 23, in place of the toner cartridges 32C, 32M, 32Y, and 32K. The elements of the laser printer 20B of the second embodiment identical with those of the color laser printer 20 of the first embodiment are expressed by the like numerals and are not specifically described here.

The four toner cartridges 32*a* through 32*d* attached to the developer unit 23 in the laser printer 20B of the second embodiment are identical with the toner cartridge 32K attached to the developer unit 23 in the color laser printer 20 of the first embodiment. Storage elements 33A through 33D mounted on the respective toner cartridges 32*a* through 32*d* are identical with the storage element 33K mounted on the toner cartridge 32K. Namely the color toner cartridges 32C, 32M, and 32Y other than the black toner cartridge 32K used in the color laser printer 20 of the first embodiment are detached from the developer unit 23 and are replaced by the three black toner cartridges 32K in the laser printer 20B of the second embodiment.

The laser printer 20B of the second embodiment forms a monochromatic image with black toner supplied from one of the four toner cartridges 32*a* through 32*d*. One of the four toner cartridges is specified, in response to toner cartridge specification information included in an image formation instruction output from a computer with object image data for image formation to the laser printer 20B. For example, it is assumed that computers A through D and the laser printer 20B are connected with a network. When the computer A gives an image formation instruction including information of specifying the toner cartridge 32*a* with image data, the laser printer 20B rotates the developer unit 23 to develop and form a toner image with a supply of toner from the toner cartridge 32*a* on the photoreceptor 21. When the computer C gives an image formation instruction including information of specifying the toner cartridge 32*c* with image data, the laser printer 20B rotates the developer unit 23 to develop and form a toner image with a supply of toner from the toner cartridge 32*c* on the photoreceptor 21. The laser printer 20B of the second embodiment rotates the developer unit 23 to develop and form a toner image with a supply of toner from the specified toner cartridge on the photoreceptor 21, in response to the toner cartridge specification information included in each image formation instruction. The procedure of image formation is not the essential part of this invention and is not described in detail. In the description below, the toner cartridge specified and used for image formation is referred to as the toner cartridge 32, and the storage element mounted on this toner cartridge is referred to as the storage element 33.

Figure 8:
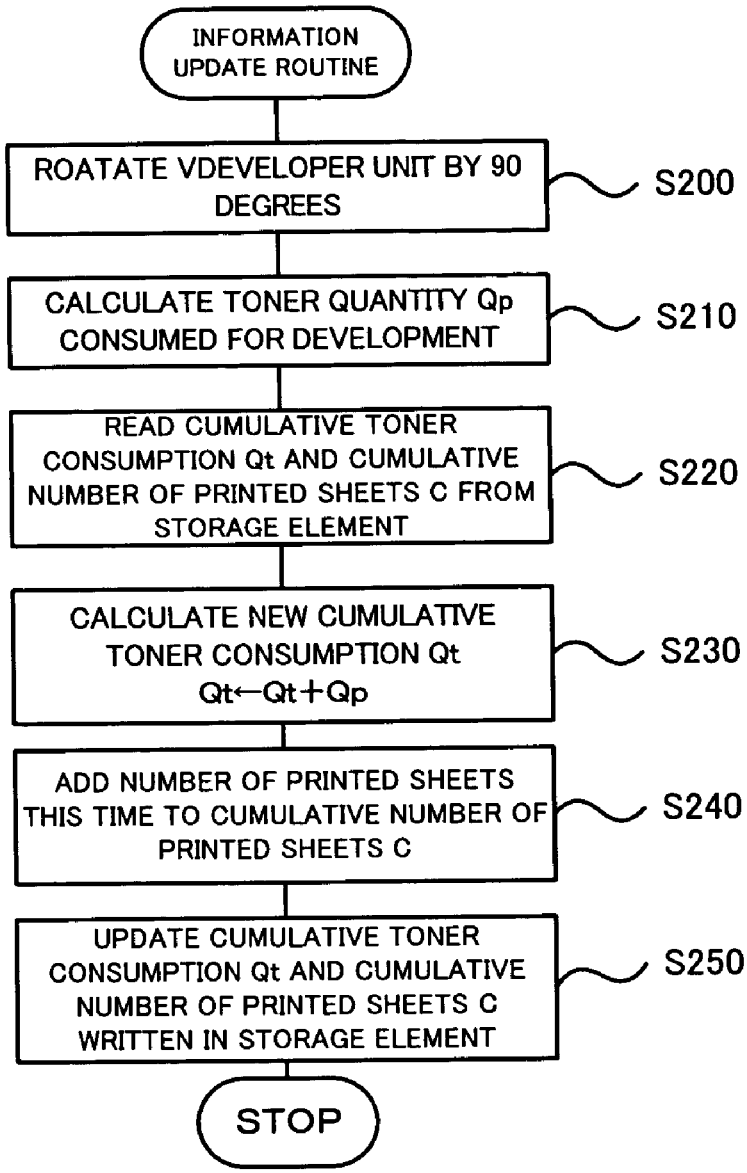
FIG. 8 is a flowchart showing an information update routine executed in the second embodiment.

The following describes an information update process carried out in the laser printer 20B of the second embodiment. FIG. 8 is a flowchart showing an information update routine executed by the controller 50 in the laser printer 20B of the second embodiment. This information update routine is executed on completion of image formation with the specified toner cartridge 32 or, in response to an image formation instruction on multiple printed sheets, on completion of image formation on all the multiple printed sheets.

When the information update routine starts, the CPU 51 of the controller 50 first rotates the developer unit 23 clockwise by 90 degrees and thereby causes the storage element 33 of the toner cartridge 32 specified and used for image formation to face the information receiver transmitter unit 30 (step S200). The routine then calculates a toner quantity Qp consumed for image formation with the toner cartridge 32 (step S210). In the case of image formation on multiple printed sheets, the total consumption is calculated as the toner quantity Qp. The calculation of the toner quantity Qp for image formation on each printed sheet counts up irradiation points of layer beam on the photoreceptor 21 and converts the count of irradiation points into the quantity of toner, as described previously.

The routine then controls the information receiver transmitter unit 30 to read a cumulative toner consumption Qt and a cumulative number of printed sheets C from the memory cell 33*d* of the storage element 33 mounted on the toner cartridge 32 (step S220). In the same manner as the first embodiment, the information receiver transmitter unit 30 is controlled to make a control signal for transmission of the cumulative toner consumption Qt and the cumulative number of printed sheets C carried on the electromagnetic wave in the predetermined frequency band and to send the electromagnetic wave with the control signal via the antenna 30*a*. In the information receiver transmitter unit 30, the antenna 30*a* receives the cumulative toner consumption Qt and the cumulative number of printed sheets C, as the information carried on the electromagnetic wave in the predetermined frequency band sent from the antenna 33*a* of the storage element 33. The receiver transmitter circuit 30*b* then analyzes the received information. The information stored in the memory cell 33*d* of the storage element 33 in the second embodiment is similar to that of the first embodiment shown in FIG. 6. Namely the stored information includes an ID allocated to each toner cartridge 32 (cartridge ID), the date of manufacture of the toner cartridge 32, the color of toner kept in the toner cartridge 32, an ID allocated to the laser printer 20B having the toner cartridge 32 attached thereto (printer ID), the use start date when the toner cartridge 32 was attached to the laser printer 20B and the use of the toner cartridge 32 started, the use end date when the toner cartridge 32 was detached from the laser printer 20B, the cumulative number of printed sheets with images printed thereon with the toner cartridge 32 by the laser printer 20B, the cumulative toner consumption consumed for printing the images with the toner cartridge 32 by the laser printer 20B, the residual quantity of toner remaining in the toner cartridge 32, and printer cumulative use information regarding cumulative use of the laser printer 20B including the total number of printed sheets with images printed thereon. Among these pieces of information, the cartridge ID, the date of manufacture, and the color of toner are written into the memory cell 33*d* as factory settings at the time of manufacture of the toner cartridge 32. The printer ID and the use start date are written by the laser printer 20B when the toner cartridge 32 is attached to the laser printer 20B. The cumulative number of printed sheets, the cumulative toner consumption, and the residual quantity of toner are updated by the laser printer 20B in a subsequent series of processing of the information update routine discussed below. The use end date and the printer cumulative use information are written by the laser printer 20B when the toner cartridge 32 is detached from the laser printer 20B.

After reading the cumulative toner consumption Qt and the cumulative number of printed sheet C, the routine adds the calculated toner quantity Qp to the cumulative toner consumption Qt to calculate the new cumulative toner consumption Qt (step S230) and adds the number of printed sheets with images printed thereon this time to the cumulative number of printed sheets C (step S240). The routine then updates the cumulative toner consumption Qt and the cumulative number of printed sheets C written in the memory cell 33*d* of the storage element 33 (step S250). In the same manner as the first embodiment, the procedure of updating the cumulative toner consumption Qt and the cumulative number of printed sheets C controls the information receiver transmitter unit 30 to make a control signal for updating the cumulative toner consumption Qt and the cumulative number of printed sheets C carried on the electromagnetic wave in the predetermined frequency band and to send the electromagnetic wave with the control signal via the antenna 30*a*. The information receiver transmitter unit 30 is also controlled to send the new cumulative toner consumption Qt and the new cumulative number of printed sheets C carried on the electromagnetic wave via the antenna 30*a*. In the storage element 33, the transmitted cumulative toner consumption Qt and cumulative number of printed sheets C are received by the antenna 33*a* and are analyzed by the signal analyzer RF 33*c*. The control unit 33*e* receives the control signal via the antenna 33*a* and stores the analyzed cumulative toner consumption Qt and cumulative number of printed sheets C at corresponding storage locations in the memory cell 33*d*. The updated cumulative toner consumption Qt and the updated cumulative number of printed sheets C may be applied to accounting for image formation by the laser printer 20B, after collection of each toner cartridge.

As described above, the laser printer 20B of the second embodiment transmits information in a contactless manner to and from the storage elements 33A through 33D of the toner cartridges 32*a* through 32*d* attached to the developer unit 23. The image formation-relating information (for example, the cumulative toner consumption Qt and the cumulative number of printed sheets C) is thus written on completion of each series of image formation into the storage elements 33A through 33D of the respective toner cartridges 32*a* through 32*d*. Each of the toner cartridges 32*a* through 32*d* is designed to have fan-shaped end faces of approximately 90 degrees, while the developer unit 23 has a quasi-cylindrical shape as a whole. The toner cartridges 32*a* through 32*d* are replaceable by the color toner cartridges 32C, 32M, 32Y, and 32K. Simple replacement of the toner cartridges enables the laser printer 20B to function as a color laser printer.

In the toner cartridges 32*a* through 32*d* of the embodiment, each of the storage elements 33A through 33D includes the antenna 33*a*, the rectifier 33*b*, the signal analyzer RF 33*c*, the memory cell 33*d*, and the control unit 33*e*. Each of the storage elements 33A through 33D receives the electromagnetic wave in the predetermined frequency band and utilizes the energy of the received electromagnetic wave for transmission of information to write or read information into or from the memory cell 33*d*. Each of the storage elements 33A through 33D thus transmits information in a contactless manner to and from the information receiver transmitter unit 30 of the laser printer 20B.

The toner cartridges 32*a* through 32*d* in the laser printer 20B of the second embodiment correspond to the multiple recording agent cartridges of the invention. The combination of the photoreceptor 21, the developer unit 23, the primary transfer unit 25, the secondary transfer unit 28, and the fixation unit 29 is equivalent to the image formation module of the invention. The information receiver transmitter unit 30 and the controller 50 respectively correspond to the information transmission module and the control module of the invention. The storage elements 33A through 33D mounted on the toner cartridges 32*a* through 32*d* of the second embodiment correspond to the storage elements of the invention. The memory cell 33*d*, the antenna 33*a*, the signal analyzer RF 33*c*, the control unit 33*e*, and the rectifier 33*b* are respectively equivalent to the memory unit, the receiver unit, the information analyzer unit, the information control unit, and the power supply unit of the invention.

The laser printer 20B of the second embodiment rotates the developer unit 23 by 90 degrees on completion of image formation to update the image formation-relating information (for example, the cumulative toner consumption Qt and the cumulative number of printed sheets C) written in the storage element 33 of the toner cartridge 32 specified and used for image formation. In one modified structure, a specific storage area is set in the RAM 53 of the controller 50 to store image formation-relating information with regard to the respective toner cartridges 32*a* through 32*d*. On completion of each series of image formation, the procedure updates the image formation-relating information stored in the RAM 53, with regard to the toner cartridge 32 specified and used for image formation. When the developer unit 23 is rotated to make the storage element 33 of the toner cartridge 32 face the information receiver transmitter unit 30, the procedure reads the image formation-relating information from the RAM 53 and updates the information written in the memory cell 33*d* of the storage element 33 mounted on the toner cartridge 32. This arrangement does not require rotation of the developer unit 23 by 90 degrees on completion of each series of image formation. In this modified structure, the image formation-relating information with regard to the respective toner cartridges 32*a* through 32*d* is stored in the RAM 53. In response to a toner cartridge detachment instruction for detachment of a specified toner cartridge, the developer unit 23 may be rotated to make the storage element of the specified toner cartridge face the information receiver transmitter unit 30. The procedure may read the image formation-relating information with regard to the specified toner cartridge from the RAM 53 and write the image formation-relating information into the storage element of the specified toner cartridge. The procedure may then rotate the developer unit 23 again to move the specified toner cartridge to a cartridge detachment position.

In the laser printer 20B of the second embodiment, the four toner cartridges 32*a* through 32*d* are attached to the developer unit 23. The number of toner cartridges attached to the developer unit 23 is not restricted to this embodiment but may be not greater than three or not less than five.

The second embodiment discussed above regards the laser printer 20B with the toner cartridges 32*a* through 32*d* filled with black toner as the recording agent. The technique of the invention is also applicable to a photocopier with multiple toner cartridges and to a printer that forms images with multiple inks as the recording agents.

The above embodiments are to be considered in all aspects as illustrative and not restrictive. There may be many modifications, changes, and alterations without departing from the scope or sprit of the main characteristics of the present invention. All changes within the meaning and range of equivalency of the claims are therefore intended to be embraced therein.

What is claimed is:

1. An image formation device that uses recording agents of multiple colors to form a color image on a medium like paper, said image formation device comprising:

an image formation module that holds multiple recording agent cartridges respectively filled with the recording agents of the multiple colors in an attachable and detachable manner and integrally moves said multiple recording agent cartridges in a circumferential direction to sequentially form corresponding color component images and to eventually form a color image with supplies of the recording agents from said multiple recording agent cartridges;

an information transmission module that is arranged at a specific location facing a preset posterior circumferential position where each of the multiple recording agent cartridges reaches after formation of a corresponding color component image at an image-forming circumferential position, said information transmission module transmitting information regarding cumulative consumption of recording agents with the additional consumption of the recording agents during formation of a corresponding color component image in a contactless, storable manner to a storage element mounted on a certain recording agent cartridge, which has just completed formation of a corresponding color component image at the image-forming circumferential position and has moved in the circumferential direction to the posterior circumferential position; and a control module that controls said information transmission module to store image formation-relating information, which regards formation of the color image by said image formation module, into each of said storage elements mounted on said multiple recording agent cartridges.

2. An image formation device in accordance with claim 1, wherein said control module controls said information transmission module to store previous image formation-relating information, which regards formation of a previous color image, in the course of formation of the corresponding color component images by said image formation module.

3. An image formation device in accordance with claim 1, wherein the image formation-relating information includes at least either of a number of formed images with regard to each of the multiple colors and a consumption of the recording agent with regard to each of the multiple colors.

4. An image formation device, in accordance with claim 1, wherein said multiple recording agent cartridges are filled with recording agents of four colors, that is, cyan, magenta, yellow, and black.

5. An image formation device in accordance with claim 1, wherein said image formation module separately holds said multiple recording agent cartridges on a rotatable, quasi-cylindrical rotary holder unit and rotates the rotary holder unit to form the respective color component images.

6. An image formation device in accordance with claim 5, wherein each of said multiple recording agent cartridges is designed to have a substantially fan-shaped cross section and form a substantially circular cross section as a whole in the case of attachment of said multiple recording agent cartridges to the rotary holder unit.

7. An image formation device in accordance with claim 5, wherein said information transmission module is located in a neighborhood of an end of the rotary holder unit.

8. An image formation device in accordance with claim 7, wherein said information transmission module is located to successively face said storage elements mounted on said multiple recording agent cartridges with rotation of the rotary holder unit.

9. An image formation device in accordance with claim 1, wherein the recording agent is either toner or ink.

10. An image formation device in accordance with claim 1, wherein said storage element comprises: a memory unit that stores information; a receiver unit that receives electromagnetic wave in a predetermined frequency band; an information analyzer unit that analyzes information carried on the electromagnetic wave in the predetermined frequency band received by said receiver unit; and an information control unit that, when the analyzed information includes storage instruction information for storage of the image formation-relating information, controls said memory unit to store the image formation-relating information, which is sent on the electromagnetic wave in the predetermined frequency band and is analyzed by said information analyzer unit, and said information transmission module transmits the information carried on the electromagnetic wave in the predetermined frequency band.

11. An image formation device in accordance with claim 10, wherein said storage element further comprises a power supply unit that utilizes energy of the electromagnetic wave in the predetermined frequency band received by said receiver unit to generate electric power required for the analysis of information by said information analyzer unit and for the storage of information by said information control unit.

12. An image formation device that uses a recording agent to form an image on a medium like paper, said image formation device comprising:

an image formation module that holds multiple recording agent cartridges respectively filled with the recording agent in an attachable and detachable manner and integrally moves said multiple recording agent cartridges in a circumferential direction to sequentially form corresponding color component images and to eventually form a color image with a supply of the recording agent from at least one recording agent cartridge among said multiple recording agent cartridges;

an information transmission module that is arranged at a specific location facing a preset posterior circumferential position where each of the multiple recording agent cartridges reaches after formation of a corresponding color component image at an image-forming circumferential position, said information transmission module transmitting information regarding cumulative consumption of recording agents with the additional consumption of the recording agents during formation of a corresponding color component image in a contactless, storable manner to a storage element mounted on a certain recording agent cartridge, which has just completed formation of a corresponding color component image at the image-forming circumferential position and has moved in the circumferential direction to the posterior circumferential position; and a control module that controls said information transmission module to store image formation-relating information, which regards formation of the image by said image formation module, into each of said storage elements mounted on said multiple recording agent cartridges.

13. An image formation device in accordance with claim 12, said image formation device further comprising:

a cartridge specification module that specifies one recording agent cartridge among said multiple recording agent cartridges, wherein said image formation module forms the image with a supply of the recording agent from said one recording agent cartridge specified by said cartridge specification module.

14. An image formation device in accordance with claim 12, wherein said control module controls said information transmission module to store the image formation-relating information into a storage element mounted on a specified recording agent cartridge, in response to a detachment instruction of said specified recording agent cartridge.

15. An image formation device in accordance with claim 12, wherein the image formation-relating information includes at least either of a number of formed images and a consumption of the recording agent.

16. An image formation device in accordance with claim 12, wherein said image formation module separately holds said multiple recording agent cartridges on a rotatable, quasi-cylindrical rotary holder unit and rotates the rotary holder unit to form the image.

17. An image formation device in accordance with claim 16, wherein each of said multiple recording agent cartridges is designed to have a substantially fan-shaped cross section and form a substantially circular cross section as a whole in the case of attachment of said multiple recording agent cartridges to the rotary holder unit.

18. An image formation device in accordance with claim 16, wherein said information transmission module is located in a neighborhood of an end of the rotary holder unit.

19. An image formation device in accordance with claim 18, wherein said information transmission module is located to successively face said storage elements mounted on said multiple recording agent cartridges with rotation of the rotary holder unit.

20. An image formation device in accordance with claim 12, wherein the recording agent is either toner or ink.

21. An image formation device in accordance with claim 12, wherein said storage element comprises: a memory unit that stores information; a receiver unit that receives electromagnetic wave in a predetermined frequency band; an information analyzer unit that analyzes information carried on the electromagnetic wave in the predetermined frequency band received by said receiver unit; and an information control unit that, when the analyzed information includes storage instruction information for storage of the image formation-relating information, controls said memory unit to store the image formation-relating information, which is sent on the electromagnetic wave in the predetermined frequency band and is analyzed by said information analyzer unit, and said information transmission module transmits the information carried on the electromagnetic wave in the predetermined frequency band.

22. An image formation device in accordance with claim 21, wherein said storage element further comprises a power supply unit that utilizes energy of the electromagnetic wave in the predetermined frequency band received by said receiver unit to generate electric power required for the analysis of information by said information analyzer unit and for the storage of information by said information control unit.

* * * * *